US008070516B2

(12) United States Patent
Chiang

(10) Patent No.: US 8,070,516 B2
(45) Date of Patent: Dec. 6, 2011

(54) ELECTRICAL CONNECTOR

(75) Inventor: Shu-Man Chiang, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 16 days.

(21) Appl. No.: 12/763,211

(22) Filed: Apr. 20, 2010

(65) Prior Publication Data

US 2011/0256766 A1 Oct. 20, 2011

(51) Int. Cl.
*H01R 13/648* (2006.01)

(52) U.S. Cl. ..... 439/607.27

(58) Field of Classification Search ..... 439/607.27, 439/83, 607.07, 607.36, 271, 607.35, 607.13
See application file for complete search history.

(56) References Cited

U.S. PATENT DOCUMENTS 6,379,184 B1 * 4/2002 Bassler et al. ..... 439/607.27
6,935,896 B1 * 8/2005 Tsai ..... 439/607.27
7,811,110 B2 * 10/2010 He et al. ..... 439/218
7,837,506 B1 * 11/2010 Chiang et al. ..... 439/607.27
7,922,535 B1 * 4/2011 Jiang et al. ..... 439/607.35

* cited by examiner

*Primary Examiner* — Edwin A. Leon

(57) ABSTRACT

An electrical connector includes an inner shell having a bottom board, two side boards and a top board to define a receiving space thereamong, an insulating body having a base portion mated with a rear of the receiving space and a tongue portion extended forward from the base portion and stretching into a front of the receiving space, a plurality of terminals disposed in the insulating body, and an outer shell mounted around the inner shell. The outer shell has a base plate electrically covered on the top board and at least one soldering tail soldered to a printed circuit board so as to achieve a ground function of the inner shell through the outer shell and the outer shell further prevents the water which enters the receiving space from an opened front end mouth of the receiving space from flowing onto the printed circuit board.

6 Claims, 4 Drawing Sheets

ELECTRICAL CONNECTOR

BACKGROUND OF THE INVENTION

1. Field of the Invention

The present invention relates to an electrical connector, and more particularly to an electrical connector having a water-proof function.

2. The Related Art

A conventional electrical connector includes an insulating body, a plurality of terminals disposed in the insulating body, and a shell mounted around the insulating body. The shell is made of a metal sheet and shows a box shape to define a receiving space therein. The insulating body has a base portion mated with a rear of the receiving space of the shell, and a tongue portion extended forward from the base portion into a front of the receiving space. The shell has a bottom board of which two opposite side edges are respectively provided with a soldering portion for being soldered to a printed circuit board. The bottom board further defines a buckling hole penetrating therethrough for locking a corresponding buckling portion of a mating connector therein. However, the water entering the receiving space from an opened front end mouth of the receiving space is apt to further flow onto the printed circuit board through the buckling hole or along the soldering portion to damage the printed circuit board. Therefore, an electrical connector capable of overcoming the foregoing problems is required.

SUMMARY OF THE INVENTION

It is an object of the present invention to provide an electrical connector having a water-proof function. The electrical connector includes an inner shell having a bottom board, two side boards and a top board to define a receiving space thereamong, an insulating body having a base portion mated with a rear of the receiving space of the inner shell and a tongue portion extended forward from the base portion and stretching into a front of the receiving space, a plurality of terminals disposed in the insulating body, and an outer shell mounted around the inner shell. The outer shell has a base plate electrically covered on the top board and at least one soldering tail soldered to a printed circuit board so as to achieve a ground function of the inner shell through the outer shell and the outer shell further prevents the water which enters the receiving space of the inner shell from an opened front end mouth of the receiving space from flowing onto the printed circuit board.

As described above, the electrical connector of the present invention can effectively prevent the water, which enters the receiving space of the inner shell from the opened front end mouth of the receiving space, from flowing onto the printed circuit board by means of the top board being wrapped by the base plate and electrically connected with the base plate to achieve the ground function of the inner shell through the outer shell.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
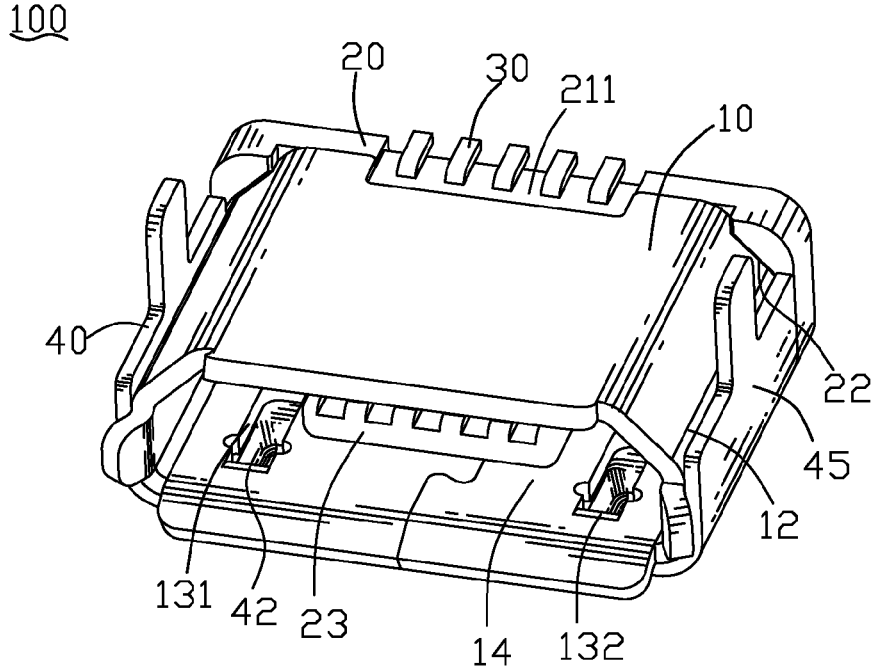
FIG. 1 is an assembled perspective view of an electrical connector in accordance with the present invention.
Figure 3:
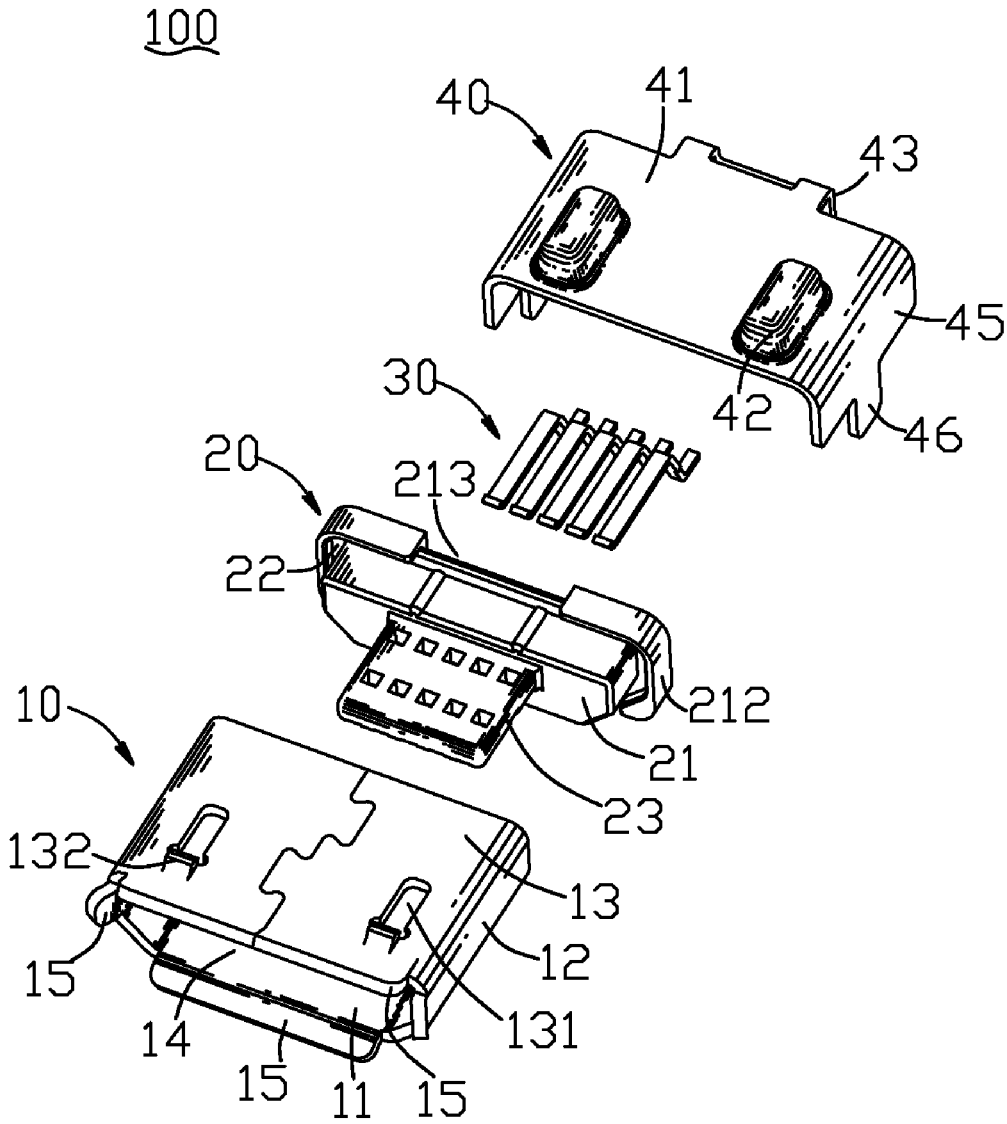
FIG. 3 is an exploded perspective view of the electrical connector of FIG. 1.

Referring to FIG. 1 and FIG. 3, an electrical connector 100 according to the present invention includes an inner shell 10, an insulating body 20 engaged with the inner shell 10, a plurality of terminals 30 integrated in the insulating body 20, and an outer shell 40 enclosing the inner shell 10.

Figure 4:
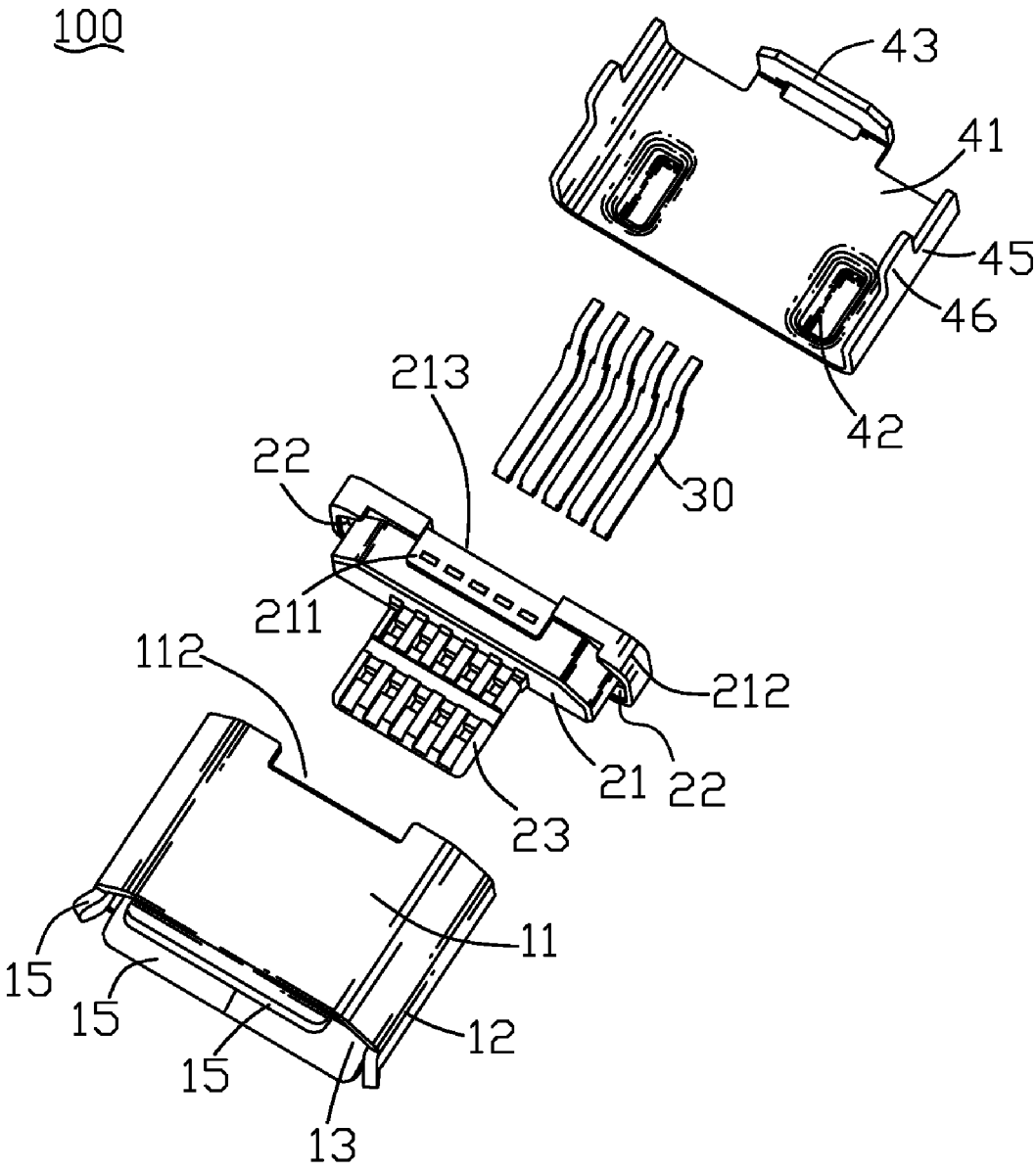
FIG. 4 is an exploded perspective view of the electrical connector of FIG. 1 viewed from another angle.
Figure 5:
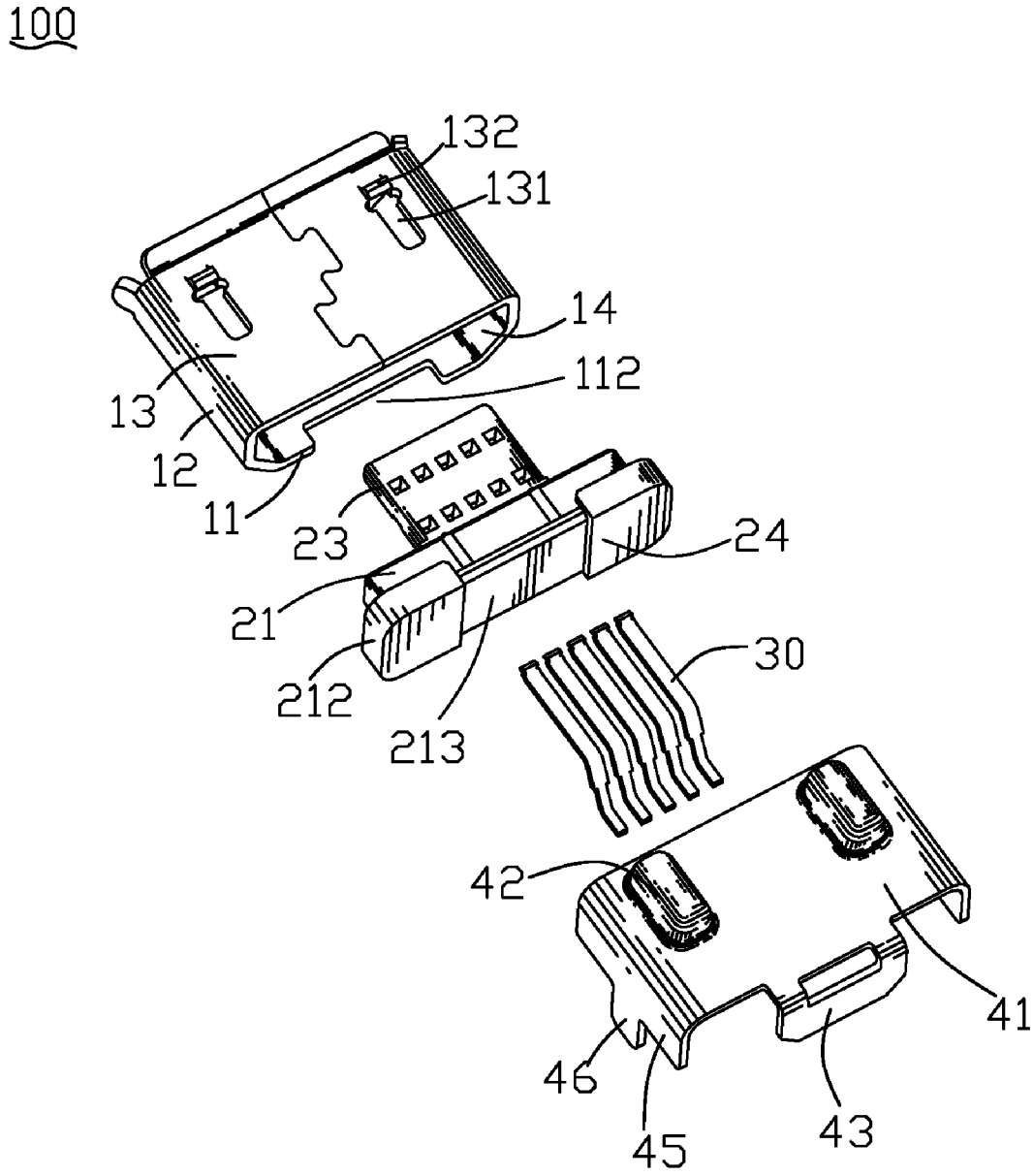
FIG. 5 is an exploded perspective view of the electrical connector of FIG. 1 viewed from a further angle.

Referring to FIG. 3, FIG. 4 and FIG. 5, the inner shell 10 has a rectangular bottom board 11. Two opposite side edges of the bottom board 11 extend upward to form two side boards 12 facing each other. Two top edges of the side boards 12 are connected by a top board 13. A receiving space 14 is formed among the bottom board 11, the two side boards 12 and the top board 13. Front edges of the bottom, side and top board 11, 12, 13 respectively extend forward and are inclined outward to form a plurality of guiding eaves 15. A middle of a rear edge of the bottom board 11 is concaved inward to form a buckling gap 112. The top board 13 defines two openings 131 at two sides thereof. A front edge of the opening 131 protrudes outward to form a locking portion 132 opposite to the receiving space 14.

Referring to FIG. 3, FIG. 4 and FIG. 5 again, the insulating body 20 has a substantially rectangular base portion 21 mated with a rear of the receiving space 14 of the inner shell 10, and a tongue portion 23 extended forward from the base portion 21. A rear middle of a bottom of the base portion 21 protrudes downward to form a buckling block 211. Two lying-U shaped preventing blocks 212 respectively encircle two opposite ends of the base portion 21 and are adjacent to a rear surface 24 of the base portion 21. A rear of the preventing block 212 is connected with a rear edge of the base portion 21, and accordingly, a buckling channel 22 is formed between a front of the preventing block 212 and the corresponding end of the base portion 21. A middle of the rear surface 24 of the base portion 21 is concaved inward to form a receiving opening 213 vertically passing therethrough.

Referring to FIGS. 3-5 again, the outer shell 40 has a rectangular base plate 41. Two opposite side edges of the base plate 41 extend downward to form two side plates 45 facing each other. A portion of a bottom edge of each side plate 45 extends downward to form a soldering tail 46. Two opposite sides of the base plate 41 are respectively punched upward to form two hollow receiving hats 42. A middle of a rear edge of the base plate 41 is bent downward to form a preventing frame 43.

Figure 2:
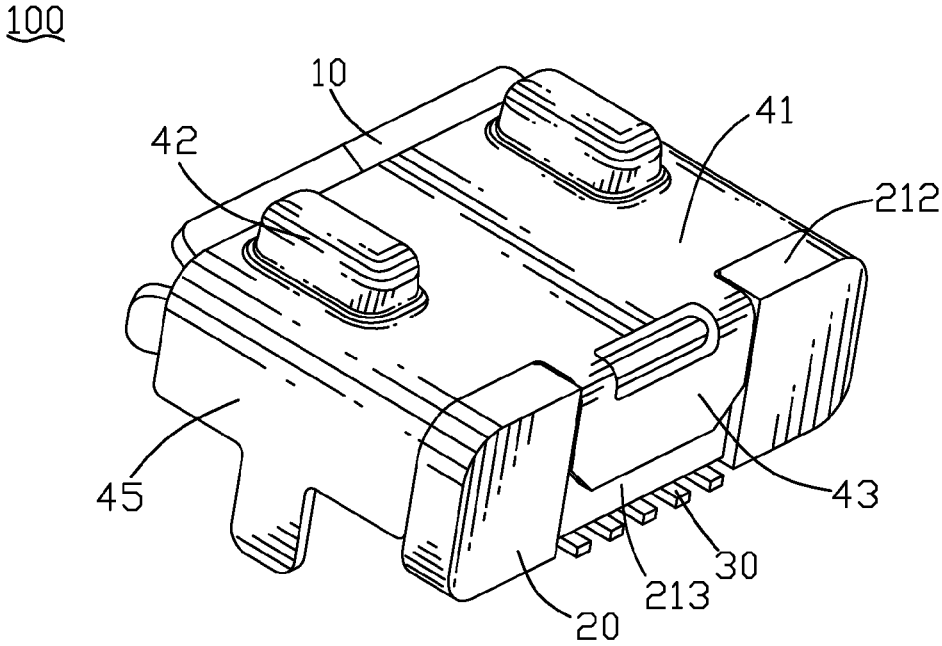
FIG. 2 is an assembled perspective view of the electrical connector of FIG. 1 viewed from another angle.

Referring to FIG. 1 and FIG. 2, in assembly, the insulating body 20 with the terminals 30 is inserted forward into the receiving space 14 of the inner shell 10. The base portion 21 of the insulating body 20 is fastened in the rear of the receiving space 14 by means of the buckling block 211 being buckled in the buckling gap 112 and rear edges of the side and top board 12, 13 being inserted in the buckling channels 22. The tongue portion 23 is received in the receiving space 14 and apart from the bottom, side and top board 11, 12, 13. Then the outer shell 40 is attached on an outside of the inner shell 10 with the base plate 41 being covered on the top board 13 and the side plates 45 being respectively against the corresponding side boards 12 to achieve a ground function of the inner shell 10 through the outer shell 40. In this embodiment, the outer shell 40 and the inner shell 10 are further soldered together with each other. Rear edges of the base and side plates 41, 45 abut against the preventing blocks 212. The preventing frame 43 of the outer shell 40 is located in the receiving opening 213 of the insulating body 20 and against an inner surface of the receiving opening 213 so as to restrain the outer shell 40. The openings 131 of the inner shell 10 face to the corresponding receiving hats 42 and the locking portions 132 are buckled in the respective receiving hats 42. The soldering tails 46 of the outer shell 40 are inserted into and soldered to a printed circuit board (not shown) for achieving a ground function of the outer shell 40 through the printed circuit board and further fixing the electrical connector 100 on the printed circuit board.

As described above, the electrical connector 100 of the present invention can effectively prevent the water, which enters the receiving space 14 of the inner shell 10 from afront end mouth of the receiving space 14, from flowing onto the printed circuit board along the openings 131 of the inner shell 10 by means of the top board 13 being wrapped by the base plate 41 of the outer shell 40 and the openings 131 being sealed by the receiving hats 42 respectively. Moreover, the inner shell 10 is electrically connected with the outer shell 40 to achieve the ground function of the inner shell 10 through the outer shell 40.

What is claimed is:

1. An electrical connector, comprising:

an inner shell having a bottom board, two side boards and a top board to define a receiving space thereamong;

an insulating body having a base portion mated with a rear of the receiving space of the inner shell, and a tongue portion extended forward from the base portion and stretching into a front of the receiving space;

a plurality of terminals disposed in the insulating body; and an outer shell mounted around the inner shell, the outer shell having a base plate electrically covered on the top board and at least one soldering tail soldered to a printed circuit board so as to achieve a ground function of the inner shell through the outer shell, and the outer shell further preventing water which enters the receiving space of the inner shell from a front end mouth of the receiving space from flowing onto the printed circuit board.

2. The electrical connector as claimed in claim 1, wherein the top board of the inner shell defines at least one opening penetrating therethrough to communicate with the receiving space, a front edge of the opening protrudes outward to form a locking portion opposite to the receiving space, a portion of the base plate of the outer shell facing the opening of the inner shell is punched oppositely to the opening to form a hollow receiving hat sealing up the opening, and the locking portion is buckled in the receiving hat.

3. The electrical connector as claimed in claim 1, wherein two opposite side edges of the base plate of the outer shell extend downward to form two side plates electrically abutting against the corresponding side boards of the inner shell, and a portion of a bottom edge of the side plate extends downward to form the soldering tail.

4. The electrical connector as claimed in claim 1, wherein two lying-U shaped preventing blocks respectively encircle two opposite ends of the base portion, a rear of the preventing block is connected with a rear edge of the base portion, a buckling channel is formed between a front of the preventing block and the corresponding end of the base portion, rear edges of the side and top boards are inserted in the buckling channels and a rear edge of the base plate abuts against the preventing blocks.

5. The electrical connector as claimed in claim 4, wherein a rear surface of the base portion defines a receiving opening, and a portion of a rear edge of the base plate is bent downward to form a preventing frame located in the receiving opening and against an inner surface of the receiving opening to restrain the outer shell.

6. The electrical connector as claimed in claim 5, wherein a bottom of the base portion protrudes downward to form a buckling block, and a rear edge of the bottom board is concaved inward to form a buckling gap for buckling the buckling block therein.

* * * * *